US007975634B1

(12) United States Patent
Dugan

(10) Patent No.: US 7,975,634 B1
(45) Date of Patent: Jul. 12, 2011

(54) BABY LEGGING WITH KNEE PAD AND PATCH

(76) Inventor: Kirsten Dugan, San Jose, CA (US)

( * ) Notice: Subject to any disclaimer, the term of this patent is extended or adjusted under 35 U.S.C. 154(b) by 306 days.

(21) Appl. No.: 12/240,347

(22) Filed: Sep. 29, 2008

Related U.S. Application Data

(63) Continuation-in-part of application No. 29/324,112, filed on Sep. 5, 2008, now Pat. No. Des. 602,232.

(60) Provisional application No. 61/094,965, filed on Sep. 7, 2008, provisional application No. 60/977,085, filed on Oct. 2, 2007.

(51) Int. Cl.
*D05B 97/00* (2006.01)
*A41D 13/06* (2006.01)

(52) U.S. Cl. ..... 112/475.09; 112/475.06; 2/24; 2/243.1

(58) Field of Classification Search ..... 112/475.09, 112/475.06, 475.08, 475.12, 475.13, 475.26, 112/475.04, 141, 147, 63, 422–426, 428; 2/22–24, 16, 59, 61, 62, 267, 80, 243.1, 239–242, 2/231; 602/26
See application file for complete search history.

(56) References Cited

U.S. PATENT DOCUMENTS 3,189,919 A * 6/1965 Chase ..... 2/16
3,322,118 A * 5/1967 Sotherlin ..... 128/892
3,406,406 A * 10/1968 Lutz ..... 2/24
3,648,291 A * 3/1972 Pankers ..... 2/16
3,798,678 A * 3/1974 Pierron et al. ..... 2/243.1
4,035,844 A 7/1977 Atack et al.
4,084,584 A 4/1978 Detty
4,116,236 A 9/1978 Albert
4,282,728 A 8/1981 Tapp et al.
4,287,885 A 9/1981 Applegate
4,315,504 A * 2/1982 Drennan et al. ..... 128/892
4,344,189 A * 8/1982 Futere et al. ..... 2/16
4,484,361 A 11/1984 Leighton et al.
D292,444 S 10/1987 Pankopf
4,756,026 A * 7/1988 Pierce, Jr. ..... 2/16
4,796,303 A 1/1989 Atwater
4,832,010 A 5/1989 Lerman
4,845,778 A 7/1989 Peterson
4,879,765 A 11/1989 Bailie et al.
D312,147 S 11/1990 Lapin
5,168,577 A 12/1992 Detty
D334,827 S 4/1993 Brown
D338,281 S 8/1993 Bottorff et al.
5,255,391 A * 10/1993 Levine ..... 2/24
D344,609 S 2/1994 Lapin
5,411,037 A 5/1995 Hess et al.
D362,951 S 10/1995 Graves
D371,452 S 7/1996 Graves
D373,455 S 9/1996 Graves
5,555,564 A 9/1996 Welch
5,784,721 A * 7/1998 Huff ..... 2/239
5,845,335 A 12/1998 Twitty
5,896,580 A * 4/1999 Aldrich et al. ..... 2/24
D417,037 S 11/1999 Bitter
6,158,051 A 12/2000 Belzidsky
6,205,593 B1 3/2001 Schaub, Jr.
6,272,888 B1 8/2001 Fujita et al.
6,301,803 B1 10/2001 Patterson
6,332,224 B1 12/2001 Walker et al.
(Continued)

*Primary Examiner* — Amy B Vanatta
(74) *Attorney, Agent, or Firm* — Aka Chan LLP

(57) ABSTRACT

Leggings with knee pads and patches protect babies when they crawl or fall on hard or abrasive surfaces.

20 Claims, 7 Drawing Sheets

U.S. PATENT DOCUMENTS

| | | | |
|---|---|---|---|
| 6,343,383 | B1 | 2/2002 | Madorma-Williams |
| 6,708,342 | B2 | 3/2004 | Boersema |
| 7,020,896 | B2 | 4/2006 | Davis |
| 7,089,598 | B2 | 8/2006 | Sallas et al. |
| 2003/0000003 | A1 | 1/2003 | Boersema |
| 2005/0060782 | A1 | 3/2005 | Sallas et al. |
| 2005/0229282 | A1 | 10/2005 | Davis |
| 2006/0117451 | A1 | 6/2006 | Sciortino |
| 2007/0022519 | A1 | 2/2007 | South |
| 2007/0044195 | A1 | 3/2007 | Atkinson |
| 2008/0047043 | A1 | 2/2008 | Flores-Garvey |
| 2008/0127394 | A1 | 6/2008 | Atkinson |
| 2009/0048550 | A1 * | 2/2009 | Feeley et al. ..... 602/26 |

* cited by examiner

BABY LEGGING WITH KNEE PAD AND PATCH

CROSS-REFERENCE TO RELATED APPLICATIONS

This application claims the benefit of U.S. provisional patent applications 60/977,085, filed Oct. 2, 2007, and 61/094,965, filed Sep. 7, 2008, and is a continuation-in-part of U.S. design patent application 29/324,112, filed Sep. 5, 2008 and issued as U.S. patent D602,232 on Oct. 20, 2009, which are incorporated by reference along with all other references cited in this application.

BACKGROUND OF THE INVENTION

The invention relates to a garment or article of clothing for protecting legs, and more specifically, to leggings with a knee pad and patch for babies or infants.

During the early stages of a baby's life, before developing walking and running skills, babies, infants, and even toddlers crawl around. Crawling usually involves moving about on knees and hands, with support from the toes. Babies enjoy crawling and crawl on whatever surface is available.

Often babies injure their knees and legs while crawling. Some surfaces such as cement, gravel, tile, and other hard or abrasive surfaces are especially harsh on a baby's soft, delicate skin. Crawling on any surface for extended periods of times can injure the baby's skin. Also, although babies are born with knee caps, the knee caps do not ossify until about two years of age or older. A baby's knee cap is just cartilage until it ossifies, which means the baby may experience more discomfort when crawling or falling, especially on harder surfaces.

Even after a child learns how to walk, they still can injure their knees. A toddler who is walking for the first time in life is often unsteady on their legs. They stand, take a step or two, and then fall, and this can repeat again and again many times a day. Toddlers often fall down on stairs too.

Therefore, there is a need for leggings with a knee pad and patch for babies, so that babies are less likely to injure their knees and legs. The leggings will also provide comfort to the baby.

BRIEF SUMMARY OF THE INVENTION

Leggings with knee pads and patches protect babies when they crawl or fall on hard or abrasive surfaces. A pair of comfortable, durable, and aesthetically appealing stretch leggings with knee pads and patches for infants protects their knees from scratches, scrapes, bruises, and rug burns when crawling on carpet surfaces, hardwood floors, grass, concrete, and other hard surfaces. These leggings are machine washable and dryable.

These leggings are more versatile: provide cushioning, protection and traction for crawling infants and toddlers; protect an infant's knees and legs from scratches, scrapes, bruises, rug burns when crawling on carpeted surfaces, hardwood floors, grass, concrete and other hard surfaces; protect falling toddlers from scraped and bruised knees; can be worn over leggings that cover an infant's entire lower torso and feet; do not have to be removed when changing diapers; can be removed from infant without taking off other articles of clothing; can be worn with different types of clothing such as "onesies" (i.e., one-piece baby body suit), short or long pants, dresses and jumpers, socks and shoes; are constructed of materials that are stretchable, breathable, comfortable and durable; and are aesthetically appealing.

Various implementations include: Leggings will be manufactured in a number of stretch fabrics, colors, patterns and styles. Patches can be manufactured in a number of different materials, shapes and sizes. Knee pads can be made in a number of different materials, shapes and sizes. The leggings can be constructed to cover entire lower torso from the waist down, including feet. The leggings can be constructed to cover entire lower torso from the waist down, including feet portion which can be folded up to expose bare feet. Leggings can be constructed in different sizes of the components to accommodate smaller and larger infants and toddlers. Leggings can be constructed to cover from the upper thighs down to and including the feet.

In an implementation, a garment includes: a tubular section, open at a top and bottom end; a top cuff, sewn to the top end of the tubular section; a bottom cuff, sewn to the bottom end of the tubular section, where the top cuff has a greater width than the bottom cuff; a knee pad, on an inside of the tubular section; a knee pad cover, on the inside of tubular section, having stitching around the entire pad cover to hold the knee pad to the tubular section; and a patch, sewn to the tubular section over the knee pad.

In various implementations, the bottom cuff does not have a bootie for a foot. The tubular section is about 9 inches long. The tubular section can be about 9 inches long or less, or about 9 inches long or more. A circumference of the tubular section is about 7½ inches around. A circumference of the tubular section can be about 7½ inches around or less, or about 7½ inches or more. The patch is oval shaped or rounded rectangle shaped. A distance from a center of the patch to the top end is about the half a length of the tubular section.

The tubular section is made from a fabric comprising cotton and spandex. Lycra® may be used instead of or in combination with spandex. Lycra fiber is a trademark of Invista. Lycra will keep its shape, fit the body comfortably and is breathable and soft.

The knee patch is suede or faux suede. The top cuff is at least 1 inch longer than the bottom cuff. When the garment is a right legging, a seam for the tubular section is to a right of the patch.

In an implementation, the method includes: folding a first rectangular cuff piece in half and sewing a first shorter end and a second shorter end of the folded first cuff piece; folding a second rectangular cuff piece in half and sewing a first shorter end and a second shorter end of the folded second cuff piece; sewing a patch piece to a body piece; sewing an overlock stitch around an edge of a knee pad cover; placing a knee pad on a inside side of the body piece, positioned over the patch; placing the knee pad cover over the knee pad and sew around the knee pad cover, whereby the knee pad cover secures the knee pad to body; folding the body piece, with patch, knee pad, and knee pad cover, in half and sew a long edge of the folded body piece using an overlock stitch to form a tubular section; sewing the folded second cuff piece to a top end of the tubular section; and sewing the folded second cuff piece to a bottom end of the tubular section.

In various implementations, the first rectangular cuff piece is about 6½ inches by about 3½ inches. The second rectangular cuff piece is about 5½ inches by about 2½ inches. The body piece is about 9½ inches by about 8 inches. The knee pad and pad cover have the same shape, and the pad cover is larger than the knee pad. The knee pad is thicker than the pad cover. The patch is oval and about 2¾ inches by about 2¼ inches. The knee pad includes foam with a concave surface. The knee pad can include foam with a flat surface. The patch includes an ornamental image. The patch can not include an ornamental image and have a plain front.

In an implementation, the knee pad foam is flat and becomes concave once the legging is around a baby's leg, conforming to the baby's knee cap.

In an implementation, a kit includes: a right legging having a patch, knee pad, and knee pad cover; a left legging having a patch, knee pad, and knee pad cover; and a diaper or diaper cover having the same ornamental design as a fabric used in the right and left legging.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
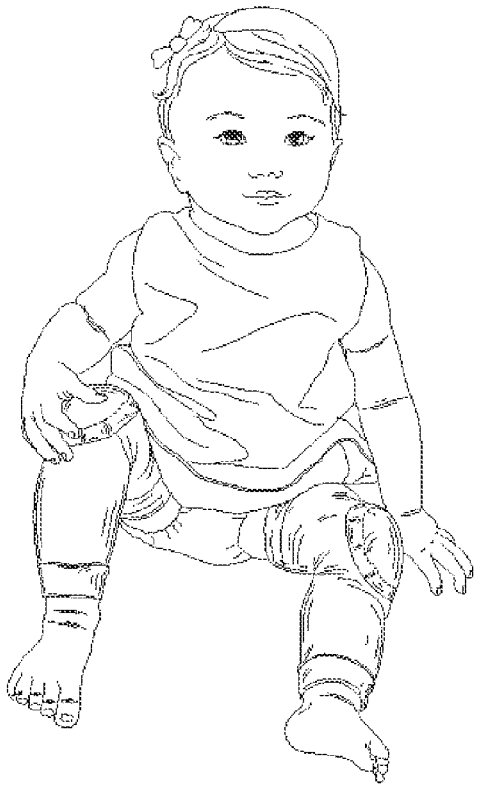
FIG. 1 shows a baby wearing a pair of leggings with a knee pad and patch.

FIG. 1 shows a baby wearing a pair of leggings with a knee pad and patch. The baby has right and left leggings, each of which has a knee pad and patch. While the leggings are on the baby, someone (e.g., mom, dad, or a nanny) can change the baby's diaper without needing to remove the leggings. In an implementation, a design of the material for the diaper matches a design of the material for the leggings.

Figure 2:
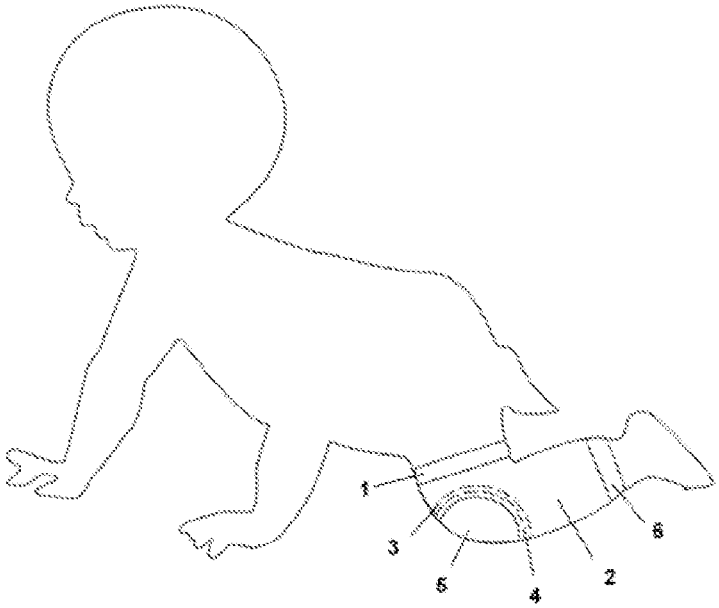
FIG. 2 shows a baby crawling while wearing a legging with knee pad and patch.

FIG. 2 shows a baby crawling while wearing a legging with knee pad and patch. The legging has a top cuff 1, body portion 2, knee pad 3, knee pad cover 4, patch 5, and bottom cuff 6.

Figure 3:
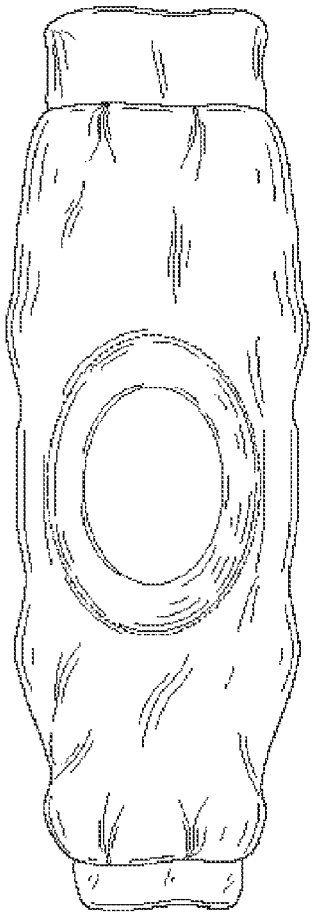
FIGS. 3-5 show a baby legging with an oval patch and oval knee pad.
Figure 4:
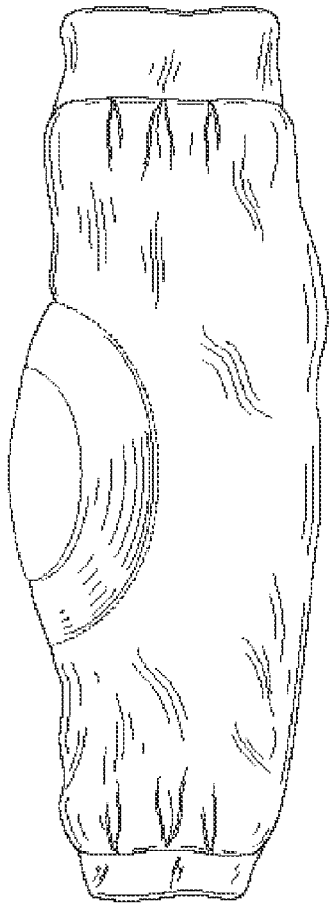
Figure 5:
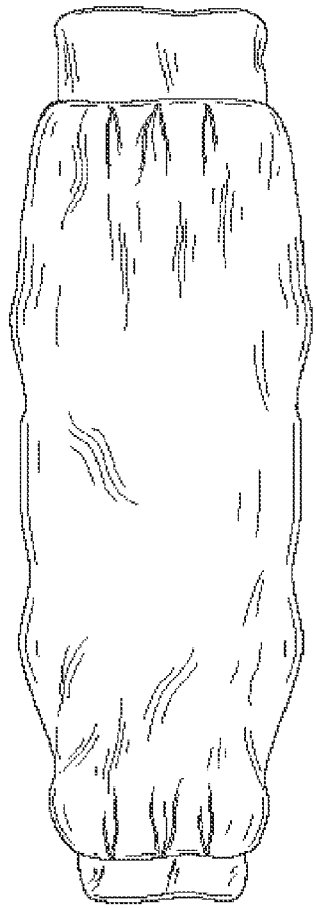

FIGS. 3-5 show a baby legging with an oval patch and oval knee pad. FIG. 3 shows a front view, FIG. 4 shows a side view, and FIG. 5 shows a back view.

A baby legging can have a patch and knee pad of any shape or geometry, not just oval. For example, the shape can be a rectangle, square, round, circular, polygon, hexagon, concave, convex, or any other shape. The patch and knee pad can have different shapes from each other, and these different shapes can be combined in any combination. For example, the knee pad can be rectangular while the patch is oval. The knee pad can be oval while the patch is rectangular.

Typically, leggings are used two at a time because babies have two legs, one legging for each leg. The right and left leggings are usually mirror images of each other, but in some implementations, the right and left leggings are exactly the same as each other.

Figure 6A:
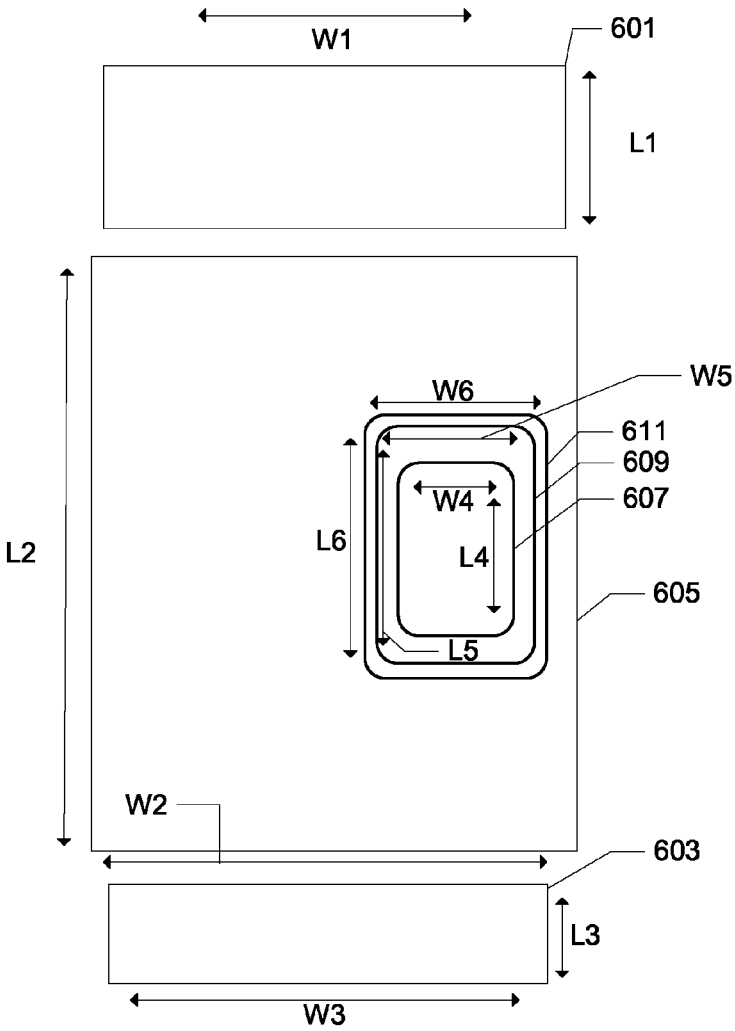
FIG. 6A shows a pattern view of the materials for a rounded rectangle implementation of the baby leggings.
Figure 6B:
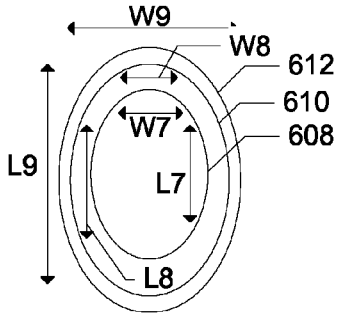
FIG. 6B shows a pattern view of materials for an oval implementation of the baby leggings.

Table A lists materials used to create a baby legging with a knee pad and patch and the approximate dimensions of these materials. The table has materials for an oval implementation and rounded rectangle implementation. The quantity is two because this is the amount of material needed to make two leggings. If a greater number of leggings is desired, the quantity can be increased. Refer to FIGS. 6A and 6B for the reference number and dimension references.

TABLE A

| Quantity | Portion of Legging | Rounded Rectangle Implementation (Rounded Rectangle Pad, Rounded Rectangle Patch) | Oval Implementation (Oval Pad, Oval Patch) |
|---|---|---|---|
| 2 | Top Cuff (601) | 3½-inch length (L1) by 6½-inch width (W1) stretch cuff material (e.g., jersey spandex) | 3½-inch length (L1) by 6½-inch width (W1) by stretch cuff material (e.g., jersey spandex) |
| 2 | Bottom Cuff (603) | 2½-inch length (L3) by 5½-inch width (W3) by stretch cuff material (e.g., jersey spandex) | 2½-inch length (L3) and 5½-inch width (W3) stretch cuff material (e.g., jersey spandex) |
| 2 | Body (605) | 9½-inch length (L2) by 8-inch width (W2) by stretch body material (e.g., jersey spandex) | 9½-inch length (L2) by 8-inch width (W2) stretch body material (e.g., jersey spandex) |
| 2 | Patch (607, 608) | 2½-inch length (L4) by 2¼-inch width (W4) rounded rectangle material (e.g., faux suede) | 2¾-inch length (L7) by 2¼-inch width (W7) oval material (e.g., faux suede) |
| 2 | Pad (609, 610) | 3-inch length (L5) by 2¾-inch width (W5) rounded rectangle pad | 3½-inch length (L8) by 3-inch width (W8) oval pad (e.g., foam) |
| 2 | Pad Cover (611, 612) | 3⅜-inch length (L6) by 3⅛-inch width (W6) rounded rectangle material | 3¾-inch length (L9) by 3⅜-inch width (W9) oval material |

FIG. 6A shows a pattern view of the materials for a rounded rectangle implementation of the baby leggings. FIG. 6B shows materials for a oval implementation. A patch 607 has a rounded rectangle shape and measures about 2½ inches in length (L4) by about 2¼ inches in width (W4). In the oval implementation, a patch 608 has an oval shape and measures about 2¾ inches in length (L7) by about 2¼ inches in width (W7).

In a specific implementation, the patch is made from suede (e.g., suede leather, imitation suede, faux suede, polyester suede, microfiber material, or polyester), but in other implementations, other durable materials can be used (e.g., silicone, rubber, vinyl, leather, felt, a coated material, burlap, corduroy, or denim). Faux suede is machine washable and machine dryable.

A durable material protects against wear and tear to the legging, especially when the baby crawls over an abrasive surface (e.g., gravel, cement, and bark). A durable patch material will allow the patch to last longer under such conditions. The patch provides some additional protection for a baby's knees. The patch reinforces the body of the fabric, generally giving the legging longer longevity.

Although the figures show a legging with a patch, the patch is optional. Some implementations of the legging do not include the patch. Even without the patch, the knee pad will still provide babies and toddlers with protection when crawling (or falling) on rough surfaces.

For the legging without the patch, the body material of the legging will be outermost layer and not have any breaks or changes. The legging without the patch may be more aesthetically pleasing to some people than with the patch. Further, by omitting the patch, the legging will be typically less expensive to produce because some material (i.e., patch) is being omitted and also the time taken to incorporate the patch into the legging is not needed. The legging without the patch can be a more economical version of the legging.

A knee pad 609 has a rounded rectangle shape and measures about 3 inches in length (L5) by about 2¾ inches in width (W5). In another implementation, the knee pad is oval 610, measuring about 3½ inches in length (L8) by 3 inches in width (W8).

In a specific implementation, the knee pad is a cushion made of compressed layers of polyester (e.g., NU-Foam®, which is a registered trademark of Fairfield Processing Corporation), which has about a ½-inch to 1-inch thickness. However, other implementations may use other types of cushioning material. The knee pad material or thickness of the knee pad can be determined by the cushioning needed. For example, infants or toddlers needing more protection can use a legging made with a thicker knee pad material (e.g., 1-inch thick or greater). On the other hand, infants needing basic protection from simple crawling may only need a standard-sized knee pad with minimal padding (e.g., ½-inch thick).

In a specific implementation, the knee pad is a single piece of foam material. Other implementations may utilize knee pads with flexible or angulated sections (e.g., like a padded bra cup or concave piece of padding), thus providing for more efficient bending of the pads at the knees. The foam material can be a memory foam or have multiple layers or multiple pieces, where each layer has a different characteristic. For example, the foam can have a higher density layer on an outside, and a lower density layer on an inside (which is a foam layer closest to the baby's skin).

A knee pad cover 611 has a rounded rectangle shape and measures about 3⅜ inches in length (L6) by about 3⅛ inches in width (W6). However, in other implementations, the knee pad cover 612 is oval shaped and measures about 3¾ inches in length (L9) and about 3⅜ inches in width (W9). In a specific implementation, the knee pad cover is made of the same material as the body of the stretch legging.

Typically, the knee pad cover is the same shape as the knee pad because the knee pad cover covers the knee pad. The knee pad cover provides an inner lining surface between the pad and the infant's skin. This allows for the infant to feel a more comfortable and cushioned fit. Both the knee pad and knee pad cover are sufficiently flexible to readily bend at the knees of an infant or toddler wearing the leggings.

The knee pad cover holds the pad to the body of the legging, so that it cannot be lost (such as while the legging is being washed). In a specific implementation, the knee pad is not removable from the legging because it is complete enclosed by the knee pad cover.

However, in other implementations, the knee pad is removable. For example, the knee pad can be held in place using the knee pad cover, which has a zipper, velcro, button, pocket, or other fastening technique to removably hold the knee pad to the legging. Then, the knee pad can be removed and the knee pad and legging can be washed individually as desired. For example, depending on the material used for the legging, it may not be desirable to put the knee pad in the dryer, while the other portions of the legging can be.

In another implementation, the pad cover is two sided, where the knee pad is enclosed between two pieces of pad cover fabric. For example, two pieces of fabric are sewn together around the pad, and then sewn onto the inside of legging so that it is centered over the area of the patch.

A body 605 is a stretch material (e.g., stretch ribbing material). The body measures about 9½ inches in length (L2) and about 8 inches in width (W2) when fully spread out prior to being sewn together. The stretch material will make up the body of the stretch leggings and may be made from a variety of different stretch materials.

In a specific implementation, the stretch material is jersey spandex. The material is about 90 percent cotton and about 10 percent spandex which yields material with a weight of about 11-11.05 ounces. However, other implementations can have other weights as indicated in table C below. For example, some weights include 10.5-11 ounces, 10-10.5 ounces, 9-10 ounces, 8.5-9 ounces, or 7.5-8.5 ounces.

A top cuff material 601 is typically made from the same material as the body. In an implementation, the top cuff material is about 3½ inches in length (L1) and about 6½ inches in width (W1) when spread out prior to being sewn. The top cuff provides holding support so the leggings stay on the baby's leg, even while the baby is aggressively crawling around.

The elastic and stretch nature of the stretch material also enables rapidly growing infants to fit for a longer period of time and to accommodate the physical differences of infants. In an implementation, the top cuff (and bottom cuff) can also include an elastic band.

A bottom cuff material 603 is typically made from the same material as the body of the leggings. The bottom cuff prevents the stretch legging from rolling or riding up the infant's leg. This assures stability from the bottom portion of the stretch legging. The bottom cuff material should be about 2½ inches in length (L3) and 5½ inches in width (W3) when spread out prior to being sewn.

The sizes specified in table A are to make a pair of stretch leggings with knee pads and patches having a finished size of about 12½ inches by about 3¾ inches to about 4 inches. The sizes in table A give the dimensions of the starting material. Before sewing, the measurements are 15½ inches by about 4 inches. But, the finished product has seams that are typically from about ⅛ inches to about ¼ inches on either side of the raw edges, which results in the smaller finished size after sewing.

For stretch leggings of a different size, the sizes of the starting materials can be adjusted to achieve a desired finished size. For example, the stretch leggings can be made in various sizes such as small, medium, large, 6 months, 6-12 months, 1-3 months, 3-6 months, 12-18 months, 18-24 months, boy's, girl's, or others. Similar materials and techniques can be used to create protective clothing for elbows, feet, or hands.

For larger sized leggings, the same pattern and instructions as described in this patent can be used. However, the width of the measurements for the body material, the top cuff, or the bottom cuff, or any combination of these, can be increased by about ¼ inch up to about 1 inch. Body length can be increased or decreased proportionately as well.

For smaller sized leggings, the same pattern and instructions as described in this patent can be used. For smaller stretch leggings, the width measurement of the body material, the top cuff, or the bottom cuff, or any combination of these, can be decreased by about ¼ inch up to about 1 inch. Body height may decrease or increase as well.

Table B shows some specific measurements of different portions of finished leggings. Table B give several implementations, which can correspond to different sizes of leggings. A first implementation is a standard size and corresponds to a finished size of about 12½ inches by about 3¾ inches. The second implementation is for a smaller legging, and a third implementation is for a larger legging.

In a specific implementation, there are different sizes of leggings to accommodate different sizes, weights, and ages of babies. Typically, the sizes of the patch, pad, and pad cover will be the same or similar for the different sizes of leggings. In other implementations, the sizes of the patch, pad, and pad cover may change depending on the size. For example, a larger-sized legging will have a larger-sized knee pad and patch. This table also gives a range for the finished dimensions for different portions of the legging.

TABLE B

| Portion of Legging | First Implementation (inches) | Second Implementation (inches) | Third Implementation (inches) | Range of Dimensions (inches) |
|---|---|---|---|---|
| Top cuff length (L11) | 1½ | 1¾ | 1½ | ½-3 |
| Top cuff width (W11) | 3¼ | 3½ | 3 | 1¾-4¼ |
| Bottom cuff length (L12) | 1 | 1¼ | 1 | ½-3 |
| Bottom cuff width (W12) | 2½ | 2¾ | 2¼ | 1¾-4¼ |
| Body length (L10) | 9 | 9¼ | 8¾ | 7½-12 |
| Body width (W10) | 3¾ | 4 | 3½ | 2½-5 |

Figure 7:
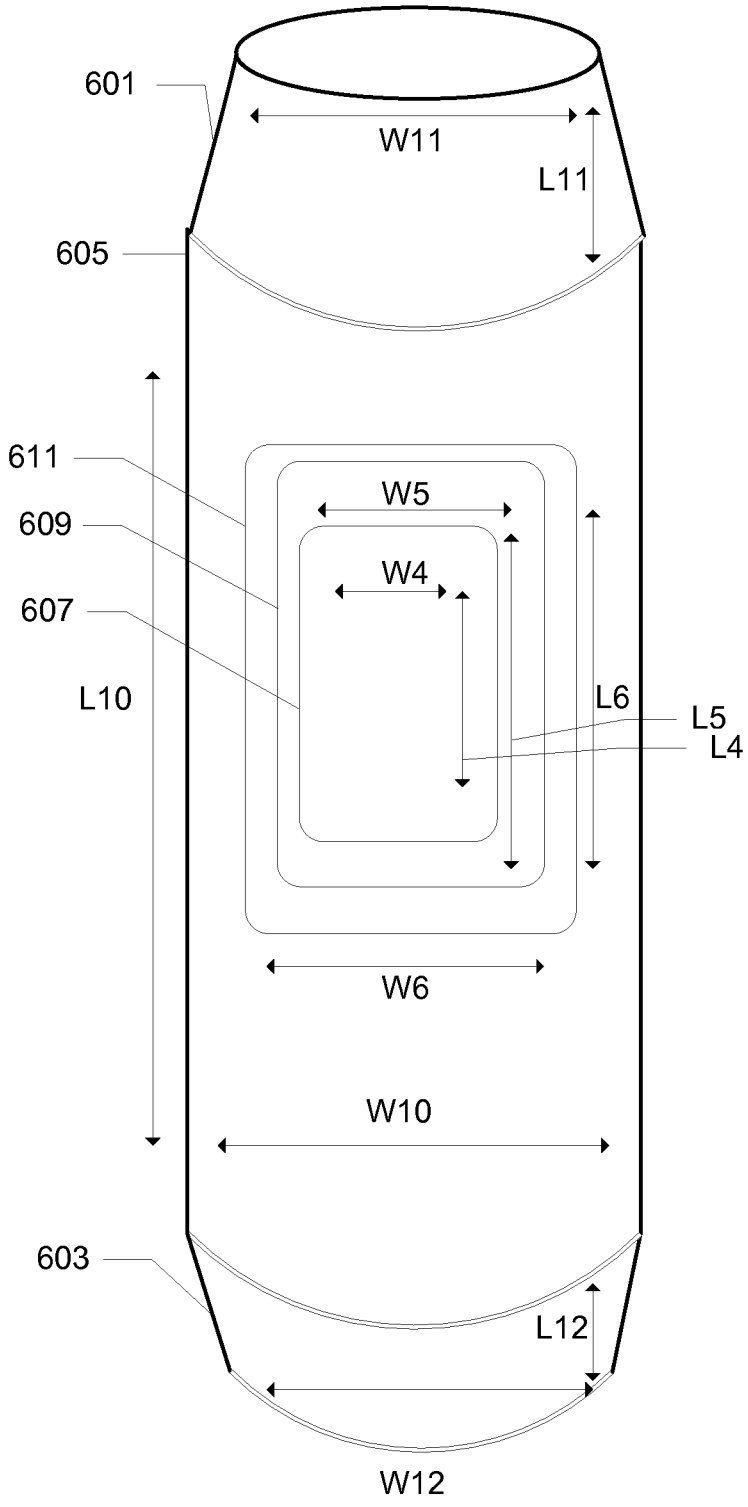
FIG. 7 shows a view of a finished legging after the materials have been sewn together.

FIG. 7 shows a finished legging after the materials have been sewn together. Compared to FIG. 6, for the finished top cuff, L11 is about half of L1, and W11 is about half of W1. For the finished bottom cuff, L12 is about half of L3, and W12 is about half of W3. The finished dimensions of the cuffs result from the cuff starting material being folded both lengthwise and widthwise (see sewing instructions below for more details). For the finished body, W10 is about half of W2.

Table B provides some specific measurements. Other measurements for the finished legging are similar to the measurements discussed in FIG. 6, except for some small differences due to the seams. For example, the seams may be about a ⅛ inch to about a ½ inch and will reduce the dimensions accordingly. For example, in an implementation, the top cuff length can vary from about 1¼ inches to about 1½ inches.

Figure 8A:
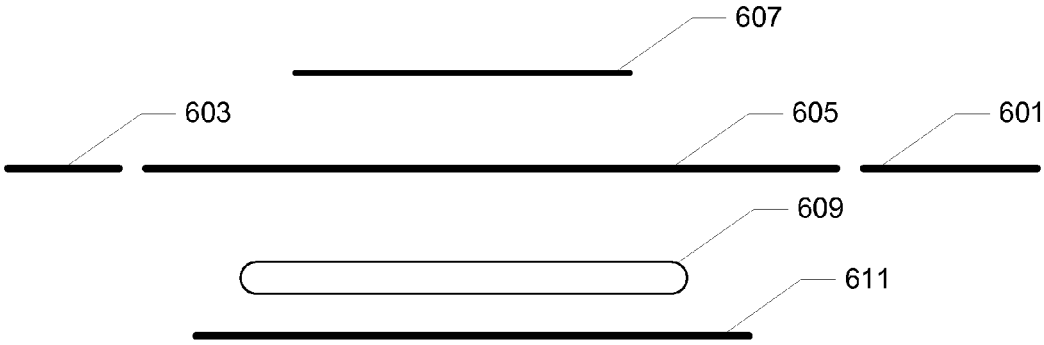
FIGS. 8A and 8B show a cross-sectional view of the materials as they are layered together in a finished legging.

FIG. 8A shows a cross-sectional view of the materials as they are layered together in a specific implementation of the finished legging. From a layer perspective, top and bottom cuffs 601 and 603 are on the same level layer as the body 605. The body section is between the top and bottom cuffs. Patch 607 (which is optional as discussed above) is above body 605. Knee pad 609 is below or beneath body 605, and knee pad cover 611 is below the knee pad.

In the finished legging, the knee pad is sewn to the inside of the body and the knee pad cover covers the knee pad. The knee pad cover holds the knee pad to the body. The patch is approximately centered over the knee pad and knee pad cover.

Figure 8B:
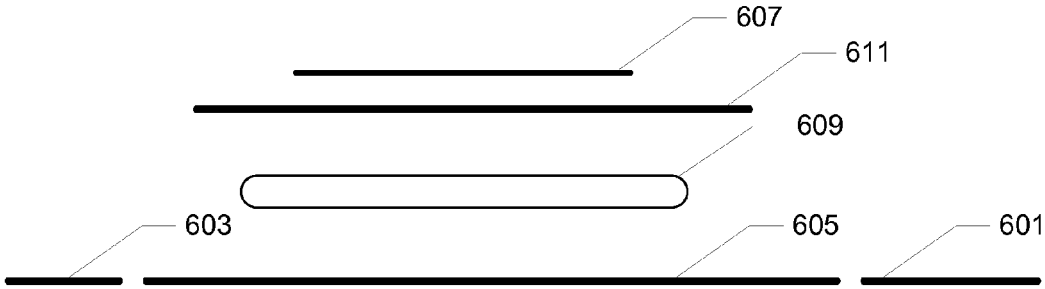

FIG. 8B shows a cross-sectional view of the materials as they are layered together in another implementation of the finished legging. The top and bottom cuffs 601 and 603 are on the same level layer as the body 605. The body section is between the top and bottom cuffs. Knee pad 609 is above body 605. Knee pad cover 611 is above knee pad 609. Patch 607 (which is optional as discussed above) is above knee pad cover 611. The body section is the bottom most layer (i.e., closest to the baby's skin).

In this implementation of the finished legging, the knee pad is sewn to the outside of the body and the knee pad cover covers the knee pad. The knee pad cover holds the knee pad to the outside of the body. The patch is approximately centered over the knee pad and knee pad cover. For this implementation, the body material is not between the patch and knee pad.

Some people may find legging with the knee pad below the body material more aesthetically pleasing than when the knee pad is above the body material, or vice versa. When the knee pad is above the body material, depending on the stitching technology used, the legging can sometimes appear as if it is turned inside out. The patch is optional and can be omitted in this legging version. Further, with the pad cover on the outside (i.e., above the body material), one can use one of the materials described the patch (e.g., suede) for the pad cover, and omit the patch. So, the pad cover will serve as the pad cover, locking or binding the knee pad to the legging, and also as a durable surface material.

Table C provides instructions for making a legging with a knee pad and patch. Table C presents a specific flow for making leggings, but it should be understood that the invention is not limited to the specific flow and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the situation.

TABLE C

| | |
|---|---|
| Step 1 | Cut the material according to the pattern and measurements as described in FIGS. 6A and 6B and above. |
| Step 2 | Sewing the top cuff. Fold the top cuff piece (601) in half widthwise (i.e., horizontally), inside out. Straight stitch seam ¼ inch in width, closing two raw edges of shorter sides of cuff, creating a double layer. Turn right-side out and refold with open lengthwise raw edges together. |
| Step 3 | Sewing the bottom cuff. Same as in step 2, but with the bottom cuff piece (603) piece. |

TABLE C-continued

| | |
|---|---|
| Step 4 | Sewing the patch on the body. Find the direct center of the patch (607). Fold the body (605) in half vertically with the right-side out (i.e., fold lengthwise with outer surface of the material facing out). Place the patch in the center of one side of ¼-inch the folded body material allowing for a seam on the raw edge of body. Unfold the body material and stitch the patch, along its edge, to the outer surface of the body, so that the stitch just goes over the edge of the patch onto the body. |
| Step 5 | Prepare the knee pad cover by sewing an overlock stitch around the edge of the pad cover. |
| Step 6 | Sewing on the knee pad and pad cover. Place the knee pad (609) on the inner surface of the body material so that it centered over the patch (which is sewn to the outer surface). Place the knee pad cover (611) over the knee pad, right-side out. Stitch around the pad cover to hold the knee pad to the body. |
| Step 7 | Sewing the body. With body facing inside out, fold the body in half lengthwise. Seam raw edges together lengthwise using an overlock stitch. |
| Step 8 | Sewing the top cuff to the body. With the right side (i.e., outer surface) of the body facing out, place the folded top cuff (from step 2), inside out, around the upper raw edge of the body material, aligning the raw edges and seam of the cuff with the seam of the body. Using an overlock stitch, sew the raw edges of top cuff to the raw edge of the body. |
| Step 9 | Sewing the bottom cuff to the body. Same as in step 8, but with the folded bottom cuff from 3. |

An overlock stitch sews over the edge of one or two pieces of cloth for edging, hemming or seaming. An overlock stitch is used to create an attractive edge and light seaming for the stretch leggings.

The flow above in table C is for the legging of FIG. 8A where the knee pad is beneath the body material. However, as discussed above and shown in FIG. 8B, the knee pad can be above the body material in some implementations. Then, steps 4 and 6 would be modified accordingly so that the knee pad is sewn to the front side of the body using the knee pad cover, and the patch is sewn over the knee pad cover.

For example, for larger size leggings, one can use the same pattern and instructions as above, and increase the width of the measurements for any of the body, top cuff, or bottom cuff, in any combination, between about ¼ inch to about 1½ inches. Body height may increase or decrease as well.

For smaller size leggings, one can use the same pattern and instruction as above, and decrease the width of the measurements for any of the body, top cuff, or bottom cuff, in any combination, between about ¼ inch to about 1½ inches. Body height may decrease or increase as well.

The above flow describes certain stitching techniques, but any other suitable stitching techniques can be used for other implementations. For example, seamless stitching technology may be applied to any, or all, the stitches in the flow. Circular knitting machines can also be used (such as for the body) to avoid seams. Other techniques to join seams together can be used.

Figure 9:
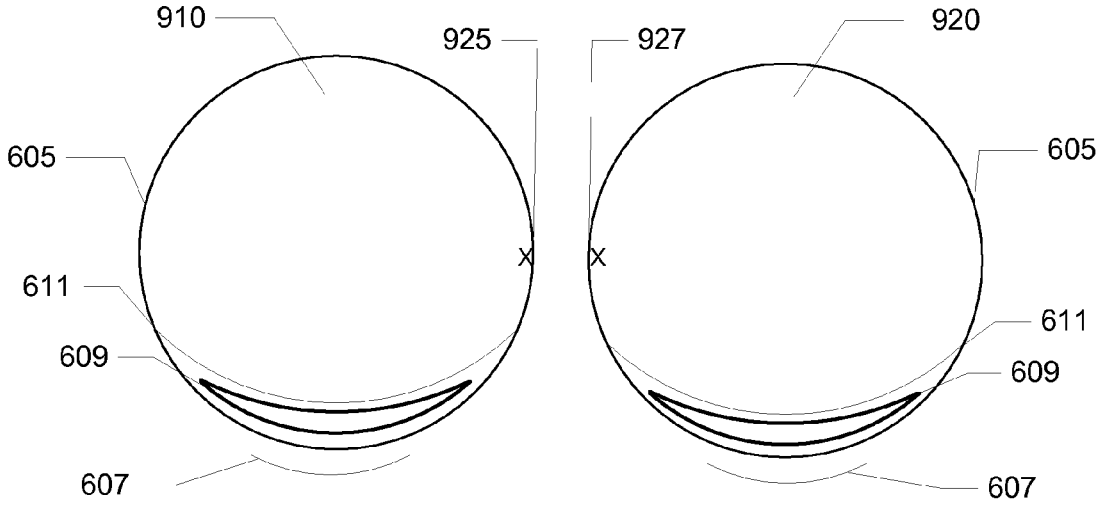
FIG. 9 shows a top view of a pair of finished leggings.

FIG. 9 shows a top view of a pair of finished leggings. There is a right legging 910 for a right leg, and a left legging 920 for a left leg. The right and left leggings are mirror images of each other. Each legging has patch 607, body 605, knee pad 609, knee pad cover 611, and cuffs.

The right legging has a seam 925, and the left legging has a seam 927. These seams are created during step 7 of the flow. In the implementation in FIG. 9, seams 925 and 927 are positioned facing each other when the leggings are worn. In other word, when on a leg, the seam of the legging is on the inside of the leg. However, in other implementations, the seams can be placed at any position, such as at the outside of the leg or back of the leg.

Leggings can be made from any desired fabric or material. Table D provides some examples of materials for leggings. These materials can be used for any fabric piece or combination of pieces of a legging. Content, fabric style, percentages, and weights are given.

TABLE D

| Pattern | Jersey Spandex | Lycra Jersey | Spandex Jersey | Cotton Spandex | Cotton, Spandex Lycra |
|---|---|---|---|---|---|
| Content | 90% cotton 10% spandex | 90% pima 10% spandex | 45% modal 45% pima cotton 10% spandex | 88% cotton 12% spandex | 93% cotton 7% spandex lycra |
| Yield (ounces) | 11-11.05<br>10.5-11<br>10-10.5<br>9-10<br>8.5-9<br>7.5-8.5 | 11-11.05<br>10.5-11<br>10-10.5<br>9-10<br>8.5-9<br>7.5-8.5 | 10.5-10<br>10-10.5<br>9.5-10<br>9-9.5<br>8.5-9<br>8-8.5<br>7.5-8<br>7-7.5<br>6.5-7 | 10.5-11<br>10-10.5<br>9.5-10<br>8.5-9<br>8-8.5 | 7.5-8<br>8-8.5<br>8.5-9<br>9-9.5<br>9.5-10<br>10-10.5<br>10.5-11 |
| Finish | Sanded or Unsanded | Sanded or Unsanded | | | |

Furthermore, as discussed above, the patch is optional and can be omitted. Then, the steps (e.g., step 4) related to the preparation and sewing of the patch can be omitted.

The specific measurements presented can increase or decrease depending on the size and the fabric used to make the body of the leggings and cuffs. The measurements can decrease up to 1 inch on the body or cuffs, or both. The measurements can increase up to 1½ inches on the body and or cuffs. The pad and patch may increase or decrease to proportional size.

Furthermore, the top or bottom cuff can be optional. For example, an implementation includes both the top and bottom cuffs. Another implementation includes only the top cuff. Another implementation includes only the bottom cuff.

The leggings can include an ultrasuede soft material. Ultrasuede® is a trademark of Toray Ultrasuede (America), Inc. Ultrasuede does not fray, pill, crock, stretch or shrink, has excellent colorfastness, is breathable, durable, and resilient. Ultrasuede can be used for the patch, or any other piece of the legging. A composition is about 65 percent polyester ultramicro fiber nonwoven with 35 percent nonfibrous polyurethane binder. A thickness is about 0.8 millimeters. A weight is about 6.43 ounces per square yard (+/−4 percent). A fiber fineness is about 0.14 deniers.

The leggings can include an ultrasuede light material. This can be used for the patch, or any other piece of the legging. A composition is about 100 percent polyester ultramicro fiber nonwoven with nonfibrous polyurethane binder. A thickness is about 0.6 millimeters. A weight is about 5 ounces per square yard (+/−4 percent). A fiber fineness is about 0.04 deniers.

The leggings can include foam (or NU-Foam) with a yield of about ½-inch to about 1-inch thickness. NU-Foam is flame retardant, hypo-allergenic, mold resistant, does not yellow or stain.

In a specific implementation, the knee pad is made of compressed layers of polyester or foam (e.g., trapping gas bubbles in a liquid or solid) may be used as the knee pad material. However, other types of cushioning material may be used, such as neoprene, rubber, plastic, polymer, saline, silicone, gel, polyester fiber, polyester fill, fiberfill, down, thick felt, poly-fil, or any type of padding. Some examples of foams include polyurethane, foam rubber, or polystyrene. For example, the knee pad is a foam pad that is 100-percent polyester.

Any fabrics or any combination of fabrics can be used to make the leggings including cotton, cotton blends, pima cotton, wool, chenille, polyester, any polyester blend, spandex, lycra, nylon, rayon, modal, and bamboo. The weaving of the fabric can be a plain weave, twill, satin, sateen, or any other weave. The fabric style can include, but is not limited to, jersey, ringspun, rib knit, nylon, jersey knit, sanded, and unsanded.

In an implementation, the knee pad cover is made of the same material as the body of the stretch legging and is cut to the same shape of the knee pad, but slightly larger. Other materials for the cover include silk, modal, mohair, or cashmere. The cover can be also the same material as the patch.

In an implementation, the patch is made of suede, either leather or imitation. Other patch materials include faux suede, ultrasuede, microsuede, leather, faux leather, plastic leather, patent leather, plastic, corduroy, French terry, denim, twill, tweed, velvet, valor, and jiffy grip. The shape of the patch can vary. In addition to oval and rounded rectangle, other shapes include star, heart, cloud, square, hexagon, and triangle.

In a specific implementation, the patch is made of a material of one solid color. Other implementations may incorporate multiple colors, designs, patterns, or images on the patch. Implementations of designs can include drawings of baseballs, basketballs, bears, bees, letter blocks, sailboats, butterflies, maple leaves, cars, cats, trains, cows, diamonds, dinosaurs, dogs, trucks, elephants, fish, flowers, footballs, frogs, hearts, shapes, horses, ice cream cones, ladybugs, monkeys, pigs, poodles, rockets, sheep, skulls and bones, soccer balls, stars, fruit, and many others.

In specific implementations, the knee pad and knee pad cover are in the shape of a rounded rectangle or oval. Other implementations of the knee pad and knee pad cover can be other shapes such as a circle, hexagon, octagon, triangle, mouse head, lips, clover, heart, or butterfly. The knee pad shape may accentuate the legging design by forming a raised region with the knee pad shape on the outside of the leggings. For example, using a heart shaped knee pad, there will be a raised heart on the outside of the leggings when worn. Thus, the knee pad and knee pad covers can offer decorative additions to the leggings.

Figure 10:
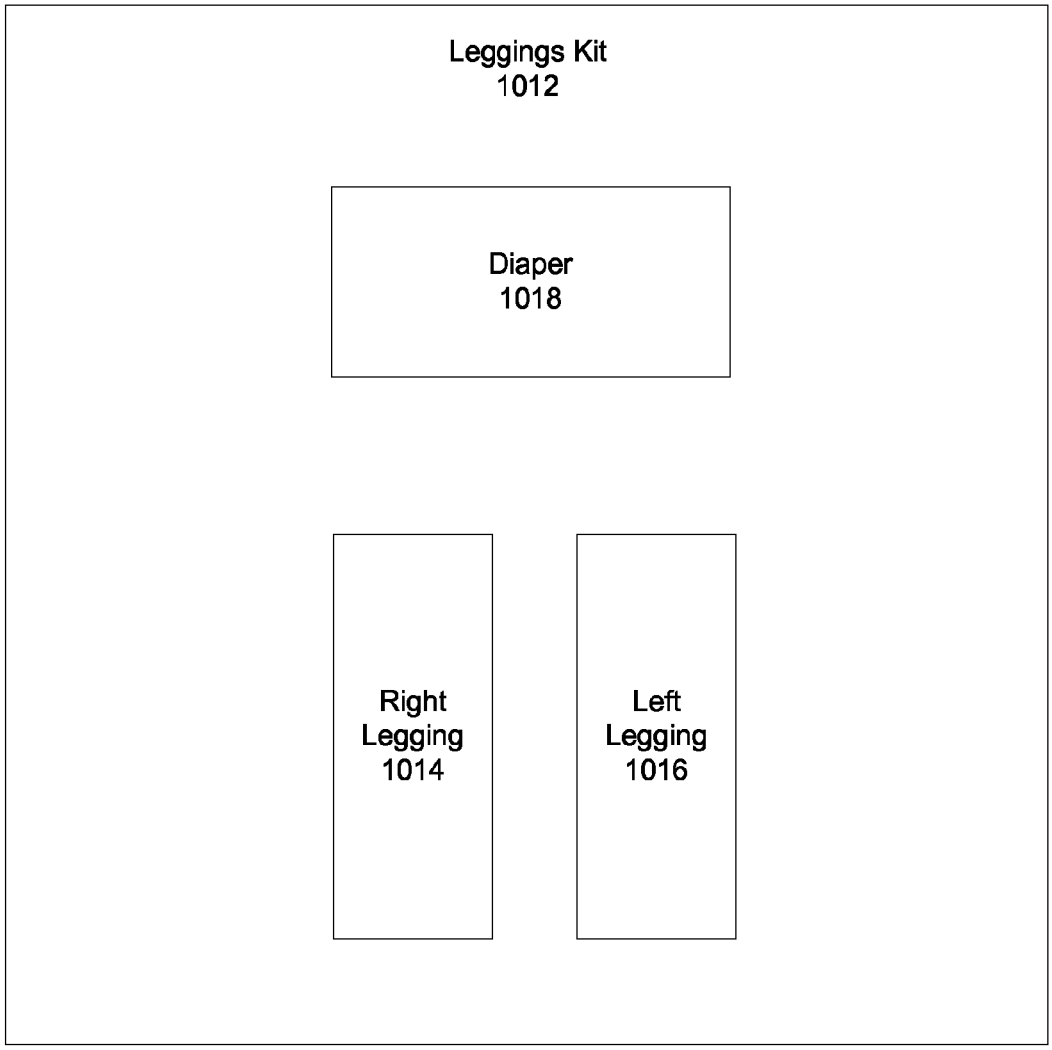
FIG. 10 shows a leggings kit.

FIG. 10 shows a leggings kit. A kit 1012 includes a right leg legging 1014, left leg legging 1016, and diaper or diaper cover 1018. The kit includes a pair of leggings and a diaper or diaper cover that matches or coordinates with the patterning of the leggings. A container for the kit holds the leggings and diaper or diaper cover. This container can be a plastic hard case, soft case, bag, translucent package, or other.

In various implementations, a kit includes a right legging having an ornamental design, a left legging having the same ornamental design as the right legging, and a diaper having an exterior material with the ornamental design. A kit includes a right legging having a color scheme, a left legging having the same color scheme as the right legging, and a diaper having an exterior material with the color scheme. A kit includes a right legging having a color scheme, a left legging having the same color scheme as the right legging, and a diaper having an exterior material with the color scheme.

For example, the leggings and diaper or diaper cover have a solid pattern. The leggings and diaper or diaper cover have a striped pattern. The leggings and diaper or diaper cover have a floral pattern. The leggings and diaper or diaper cover have a plaid pattern. The leggings and diaper or diaper cover are the same color.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A method comprising:

folding a first rectangular cuff piece in half and sewing a first shorter end and a second shorter end of the folded first cuff piece;

folding a second rectangular cuff piece in half and sewing a first shorter end and a second shorter end of the folded second cuff piece;

sewing a patch piece to a body piece;

sewing an overlock stitch around an edge of a knee pad cover;

placing a knee pad on an inside side of the body piece, positioned over the patch;

placing the knee pad cover over the knee pad and sew around the knee pad cover, whereby the knee pad cover secures the knee pad to the body piece;

folding the body piece, with patch, knee pad, and knee pad cover, in half and sew a long edge of the folded body piece using an overlock stitch to form a tubular section;

sewing the folded first cuff piece to a top end of the tubular section; and sewing the folded second cuff piece to a bottom end of the tubular section.

2. The method of claim 1 wherein the first rectangular cuff piece is about 6½ inches by about 3½ inches.

3. The method of claim 1 wherein the second rectangular cuff piece is about 5½ inches by about 2½ inches.

4. The method of claim 1 wherein the body piece is about 9½ inches by about 8 inches.

5. The method of claim 1 wherein the knee pad and pad cover have the same shape, and the pad cover is larger than the knee pad.

6. The method of claim 5 wherein the knee pad is thicker than the pad cover.

7. The method of claim 1 wherein the patch is oval and about 2¾ inches by about 2¼ inches.

8. The method of claim 1 wherein the knee pad comprises foam with a concave surface.

9. The method of claim 1 wherein the patch comprises an ornamental image.

10. A method comprising:

folding a first rectangular cuff piece in half and sewing a first shorter end and a second shorter end of the folded first cuff piece, wherein the first rectangular cuff piece has unstretched dimensions of up to about 3½ inches by up to about 6½ inches;

folding a second rectangular cuff piece in half and sewing a first shorter end and a second shorter end of the folded second cuff piece, wherein the second rectangular cuff piece has unstretched dimensions of up to about 3½ inches by up to about 5½ inches;

sewing a patch piece to a body piece, wherein the body piece has unstretched dimensions of up to about 9½ inches by up to about 8 inches;

placing a knee pad on an inside side of the body piece, positioned over the patch;

placing a knee pad cover over the knee pad and sew around the knee pad cover, whereby the knee pad cover secures the knee pad to the body piece;

folding the body piece, with patch, knee pad, and knee pad cover, in half and sew a long edge of the folded body piece using an overlock stitch to form a tubular section;

sewing the folded first cuff piece to a top end of the tubular section; and sewing the folded second cuff piece to a bottom end of the tubular section.

11. The method of claim 10 wherein the knee pad cover has unstretched dimensions of up to about 3¾ inches by up to about 3⅜ inches.

12. The method of claim 11 wherein the patch piece has unstretched dimensions of up to about 2¾ inches by up to about 2¼ inches.

13. The method of claim 10 wherein the knee pad cover has generally an oval shape.

14. The method of claim 10 wherein the knee pad cover has generally a rectangular shape.

15. The method of claim 10 wherein the patch piece comprises suede.

16. The method of claim 10 comprising:

sewing an overlock stitch around an edge of a knee pad cover.

17. A method comprising:

folding a first rectangular cuff piece in half and sewing a first shorter end and a second shorter end of the folded first cuff piece, wherein the first rectangular cuff piece has unstretched dimensions of up to L1 by up to about W1;

folding a second rectangular cuff piece in half and sewing a first shorter end and a second shorter end of the folded second cuff piece, wherein the second rectangular cuff piece has unstretched dimensions of up to about L2 by up to about W2, and W2 is less than W1;

sewing a patch piece to a body piece, wherein the body piece has unstretched dimensions of up to L3 by up to W3 inches, wherein L3 is about 3*L1;

placing a knee pad on an inside side of the body piece, positioned over the patch;

placing a knee pad cover over the knee pad and sew around the knee pad cover, whereby the knee pad cover secures the knee pad to the body piece;

folding the body piece, with patch, knee pad, and knee pad cover, in half and sew a long edge of the folded body piece using an overlock stitch to form a tubular section;

sewing the folded first cuff piece to a top end of the tubular section; and sewing the folded second cuff piece to a bottom end of the tubular section.

18. The method of claim 17 wherein W3 is greater than W2 and greater than W1.

19. The method of claim 17 wherein the knee pad cover has a larger surface area than the patch piece, and when the patch piece is placed on the knee pad cover, edges of the patch piece do not extend beyond edges of the knee pad cover.

20. The method of claim 19 wherein the knee pad comprises up to about 0.5 inches of thickness.

* * * * *